US005138334A

United States Patent [19]

Rowe et al.

[11] Patent Number: 5,138,334

[45] Date of Patent: Aug. 11, 1992

[54] PNEUMATIC SURFACE CLEANING METHOD AND APPARATUS FOR INK JET PRINTHEADS

[75] Inventors: Paul J. Rowe, Williamson; Richard A. Morano, Lyons, both of N.Y.

[73] Assignee: Xerox Corporation, Stamford, Conn.

[21] Appl. No.: 608,857

[22] Filed: Nov. 5, 1990

[51] Int. Cl.[5] ..... B41J 2/165

[52] U.S. Cl. ..... 346/1.1; 346/140 R

[58] Field of Search ..... 346/140 R, 1.1, 75; 400/126

[56] References Cited

U.S. PATENT DOCUMENTS

| | | | |
|---|---|---|---|
| 4,362,572 | 12/1982 | Wallace | 134/18 |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 4,875,054 | 10/1989 | Archer et al. | 346/1.1 |
| 4,959,673 | 9/1990 | Noda | 346/140 R |
| 4,967,204 | 10/1990 | Terasawa et al. | 346/1.1 |

FOREIGN PATENT DOCUMENTS

| | | | |
|---|---|---|---|
| 0210848 | 7/1986 | European Pat. Off. . | |
| 3719704 | 6/1987 | Fed. Rep. of Germany . | |
| 62-9957 | 1/1987 | Japan . | |
| 0048801 | 1/1988 | Japan | 346/140 R |

*Primary Examiner*—Benjamin R. Fuller
*Assistant Examiner*—Victor DeVito
*Attorney, Agent, or Firm*—Robert A. Chittum

[57] ABSTRACT

In an ink jet printer, an arrangement is provided for cleaning the face of the printhead in which the ink ejecting orifices are located. The arrangement includes a suction chamber directed towards, but spaced apart from, the printhead face to draw air over the printhead face and thereby remove any contamination such as ink residue and paper fibers. Advantageously, the suction chamber is formed in the cap member that is conventionally provided to engage the printhead and cap the ink ejecting orifices when the printhead is not in use. In that case, suction may also be applied to the cap member when it is in engagement with the printhead, to prime the printhead and/or to clear the ink ejecting orifices. Suction may then be maintained while the cap member is moved away from the printhead, so that air will be drawn over the printhead face.

10 Claims, 2 Drawing Sheets

PNEUMATIC SURFACE CLEANING METHOD AND APPARATUS FOR INK JET PRINTHEADS

BACKGROUND OF THE INVENTION

The present invention relates to ink jet printing apparatus and is concerned, more particularly, with the maintenance of a printhead in such apparatus.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in EPA 0,210,848. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printer are described in, for example, U.S. Pat. Nos. 4,855,764; 4,853,717 and 4,746,938 while the removal of gas from the ink reservoir of a printhead during printing is described in U.S. Pat. No. 4,679,059.

It has been found that the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress and, like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped. In JP-A 62-9957, it is proposed that ink leaking from a printing nozzle should be absorbed by a piece of fibrous material in engagement with the nozzle.

SUMMARY OF THE INVENTION

It is an object of the present invention to provide an improved printhead assembly for an ink jet printer, which enables effective cleaning of the printhead face to be carried out in a comparatively simple manner and without increasing the complexity of the printhead assembly.

According to the present invention, a printhead assembly for a thermal ink jet printer comprises a printhead having at least one ink channel therein, an ink ejecting orifice at one end of the channel for directing droplets of ink expelled from the channel towards a recording medium, and a printhead face containing the ink ejecting orifice(s); and a cleaning member operable to draw air over, and thereby to clean, the said printhead face.

In a thermal ink jet printer in accordance with the invention, a heating element is provided to heat ink in the channel to cause ink droplets to be expelled from the ink ejecting orifice. The cleaning member may comprise a cap member of a maintenance station of the printer, the cap member being movable towards and away from the printhead and having a first position in which it engages the printhead face and caps the printhead orifice(s) and a second position in which it is directed towards but spaced apart from the printhead face. Means is provided to apply suction to the cap member in the second position to draw air over the printhead face to clean the latter, and may also be operable to apply suction to the cap member in the first position. In one embodiment of the invention, the suction applying means is operable to apply suction to the cap member during movement of the cap member from the first to the second position.

The invention further provides a method of cleaning the face of the printhead of a printer, the printer being of the type comprising at least one ink channel within the printhead, an ink ejecting orifice at one end of the channel in the printhead face, a heating element operable to apply heat to ink in the channel to cause ink droplets to be expelled from the ink ejecting orifice and propelled towards the recording medium; and a maintenance station to which the printhead is movable and which includes a cap member movable towards and away from the printhead. The method includes the step of moving the cap member into a position in which it is directed towards but spaced apart from the printhead face, and applying suction to the cap member to draw air over the printhead face to clean the latter.

BRIEF DESCRIPTION OF THE DRAWINGS

By way of example, an embodiment of the invention will be described with reference to the accompanying drawings, in which.

DESCRIPTION OF THE PREFERRED EMBODIMENT

Figure 1:
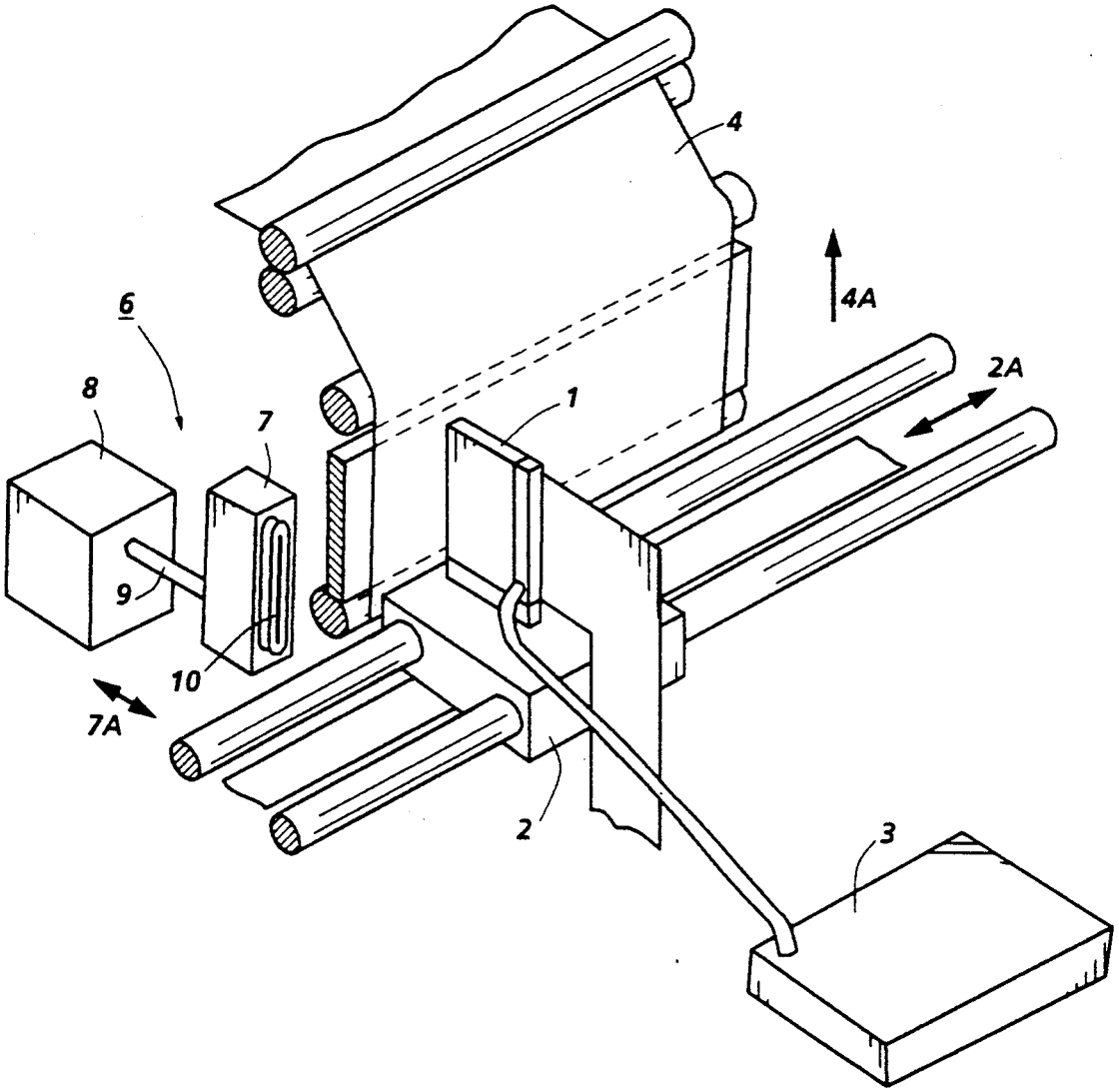
FIG. 1 is a schematic drawing of a thermal ink jet printer.

The printer shown in FIG. 1 has a printhead 1 mounted on a carriage 2 and connected to receive ink from a supply container 3. The printhead 1 contains a plurality of ink channels (not shown in FIG. 1) which carry ink from the supply container 3 to respective ink ejecting orifices (also not shown in FIG. 1). In use, the carriage 2 reciprocates as indicated by the arrow 2A and droplets of ink are expelled from selected ones of the printhead orifices (in the manner already described) and are directed towards a recording medium 4, for example a paper sheet. During each pass of the carriage 2, the recording medium 4 is stationary but at the end of each pass it is stepped in the direction of the arrow 4A. For a more detailed explanation of the printhead and printing thereby refer to U.S. Pat. No. 4,571,599 and U.S. Pat. No. Re. 32,572 incorporated herein by reference.

Figure 2:
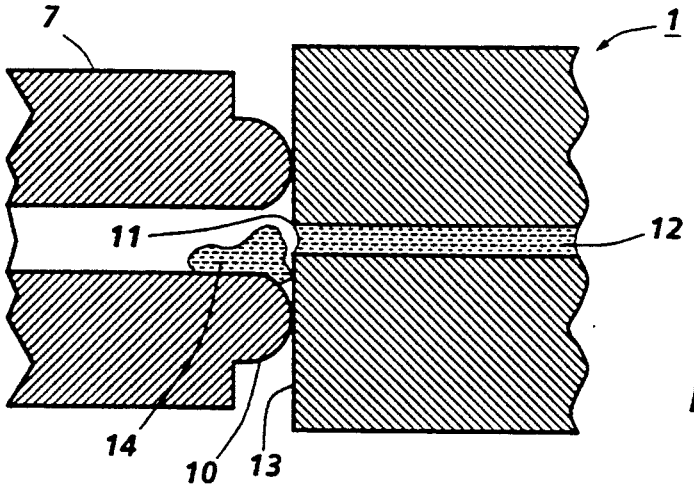
FIG. 2 is a diagrammatic cross-section showing part of a printhead and the priming/maintenance station of a thermal ink jet printer, and FIG. 3, A and B, is similar to FIG. 2 but shows the components in different relative positions.

At one side of the printer, outside the printing zone, is a priming/maintenance station 6. At the end of a printing operation, the printhead carriage 2 is parked at this priming/maintenance station 6 which comprises a cap member 7 and an associated suction pump 8 in communication through a line 9 with the interior of the cap member. The cap member 7 is movable towards and away from the printhead 1 as indicated by the arrow 7A, and has an elongated opening in its front face surrounded by an upstanding seal 10. When the carriage 2 has been parked at the station 6, the cap member 7 is moved towards the printhead 1 until the seal 10 fits tightly against the printhead and surrounds the ink ejecting orifices. This situation is illustrated in FIG. 2, in which a single orifice 11 of the printhead 1 and its associated ink supply channel 12 are shown for ease in explaining the invention, though an actual printhead would have many orifices in a linear array aligned perpendicular to the direction of reciprocation indicated by arrow 2A in FIG. 1. By capping the printhead in that way, evaporation of the ink within the printhead when the printer is idle can be inhibited. Before printing commences, the pump 8 is operated to apply suction to the cavity within the cap member 7, and thereby draw some ink from the printhead orifices 11: in that way, any dried ink or air bubbles are removed.

The station 6 is also utilized to prime the printhead 1 after a new ink supply container 3 has been installed. In that case, when the cap member 7 has been applied to the printhead, the suction pump 8 is operated to draw all air out of the printhead through the orifices 11, thereby ensuring that the printhead is full of ink before printing commences. The maintenance station can also be used to apply suction to the orifices to clear the latter during a printing operation if a deterioration in print quality should become apparent.

The operation of the priming/maintenance station 6 as so far described is conventional. Conventionally, operation of the suction pump 8 is terminated before the cap member 7 is withdrawn from the printhead 1. Droplets of ink may then remain on the face 13 of the printhead (i.e. the surface of the printhead that faces the recording medium 4 and in which the orifices 11 are located) leaving a residue which, if it is allowed to build up, may affect the print quality. For example, FIG. 2 shows how ink 14 may collect at the mouth of the cap member 7 when operation of the suction pump 8 is terminated, from which it will be apparent that some of that ink may remain on the face 13 of the printhead when the cap member is withdrawn. The face 13 of the printhead may also become contaminated by paper fibers or other foreign material during a operation, and this may likewise affect the print quality.

In accordance with the present invention, the priming/maintenance station 6 is also utilized to clean the face 13 of the printhead, to prevent the formation of an ink residue and to remove foreign material that collects during a printing operation. That is achieved by not terminating the operation of the suction pump 8 before the cap member 7 is withdrawn from the printhead but, instead, continuing to operate the pump as the cap member is withdrawn. In that case, as soon as the cap member 7 begins to move away from the printhead, air is drawn into the cap member over the printhead face 13 as indicated by the arrows 13A in FIG. 3A and, as illustrated, carries with it any ink droplets 15 that may have been left on the face together with any foreign matter that may have accumulated. The incoming air also carries further back into the cap any of the ink 14 that may have been left at the mouth of the cap and ensures that none of that ink can trickle out and be left on the printhead.

Preferably, a relative sideways movement is then effected between the printhead 1 and the cap member 7, with the suction pump 8 still in operation. That could, for example, be achieved by moving the printhead carriage 2 back into the printing position before operation of the suction pump 8 is terminated. FIG. 3B illustrates the resulting sideways movement of the printhead 1 relative to the cap member 7, in the direction of the arrow 16: by carrying out this movement while the pump 8 is still operating, a final cleaning of the printhead face 13 is carried out and any contaminants that may remain are carried clear of the printhead orifice(s) 11. When the printhead has a linear array of orifice(s) 11, the sideways movement of the printhead should be perpendicular to, rather than along, the line. Because this final cleaning movement does not involve contact between the cap member 7 and the printhead face 13, there is no risk of contaminants being swept back into the orifice(s) 11 or of damage to the printhead face.

Operation of the pump 8 is then terminated and the printhead is ready for use. It is important that the cap member 7 is not moved back against the printhead face 13 while the pump 8 is in operation because that will result in ink being drawn out of the printhead orifice(s).

Figure 3A:
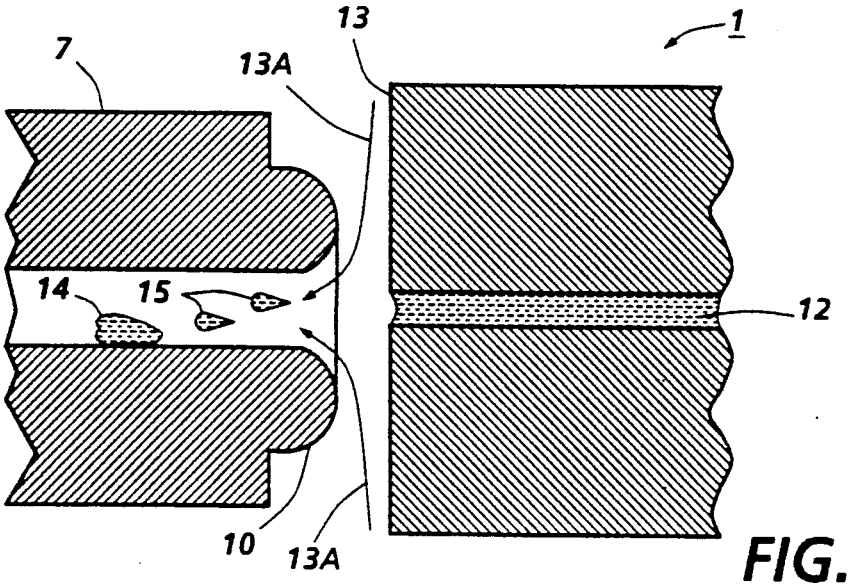
Figure 3B:
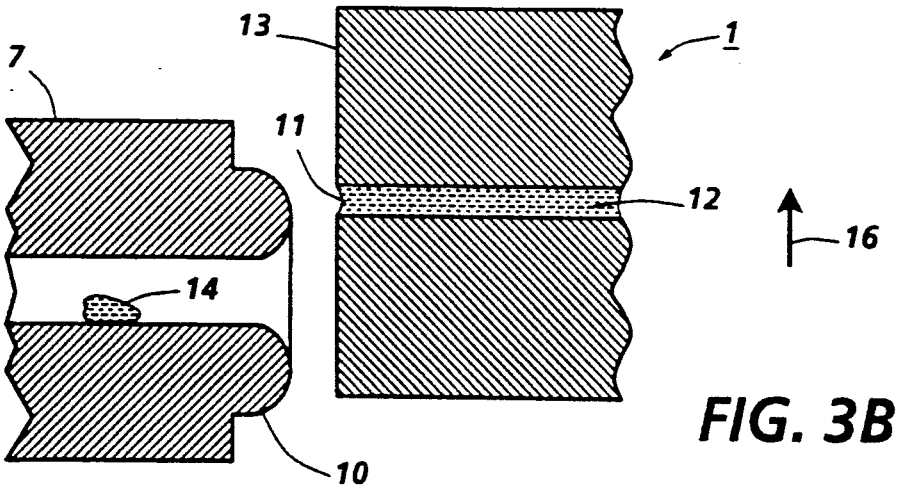

As an alternative, the cap member 7 need not be moved completely against the printhead face 13 as shown in FIG. 2 when the printhead is to be primed or when the ink channels 12 are to be cleared but can, instead, just be moved into the position shown in FIG. 3A, in which it is spaced apart slightly from the printhead face 13. The pump 8 is then operated with the cap member 7 in that position, either to prime the printhead or to clear the ink channels 12, and at the same time to clean the printhead face.

The seal 10 of the cap member 7 may be of silicon rubber and, advantageously, defines a comparatively narrow suction opening into the interior of the cap member so that a comparatively large flow of air across the printhead face 13 (FIGS. 3A and 3B) can be achieved using a comparatively small pump 8. FIG. 1 shows an elongated opening into the interior of the cap member 7, such as would be provided for a printhead having a linear array of orifices 11: the diameter of the orifices 11 is typically 60 microns and the internal width of the suction opening in the cap member is preferably in the range 15 to 20 thousandths of an inch. However, the suction opening in the cap member need not have the form shown in FIG. 1: it could, for example, be of a size suitable for priming a single printhead orifice only.

The printing machine of FIG. 1 is provided with controls to ensure the accurate positioning of the printhead at the priming/maintenance station 6, so that the suction opening in the cap member is aligned with the printhead orifice(s) 11, and to ensure the accurate movement of the cap member into sealing engagement with the printhead face 13. Those same controls can readily be adapted to achieve the cleaning movement of the cap member and the printhead illustrated in FIGS. 3A and B. Typically, the movement of the cap member 7 away from the printhead as shown in FIG. 3A will be over a distance within the range 1 to 10 thousandths of an inch, with the preferred distance being 5 thousandths of an inch.

It will be appreciated that it is not essential for the cleaning of the printhead face to be carried out using a station 6 that is provided both to cap and to prime the printhead and to clear the printhead orifices 11 (although it is convenient to use such an arrangement, when possible). For example, a printing machine may be provided with separate capping and priming stations, in which case the cleaning operation described would be carried out at the priming station. Alternatively, any suitable arrangement could be provided to draw air over the printhead face by applying suction to the printhead at a small distance from the printhead face. Such an arrangement could, for example, be provided for a printhead which is primed by applying a positive pressure to the ink supply to force ink through the orifices rather than by using a cap member such as that shown at 7 in FIG. 1 to prime the printhead by applying suction to the orifice(s) 11.

It will also be appreciated that, although the cleaning procedure described above with reference to FIGS. 2 and 3 is associated with the step of priming the printhead 1, exactly the same procedure could be associated with the step of cleaning the printhead orifice(s) 11 which is carried out periodically during a printing operation, particularly when a deterioration in print quality becomes apparent.

The procedure for cleaning a printhead face as described above can be used with other forms of drop-on-demand printers, including printers having a plurality of printheads and printers in which, instead of a remote ink supply, the or each printhead has its own ink cartridge which is also mounted on the carriage 2. A similar cleaning procedure could also be used in printers in which the printheads are not mounted on a reciprocable carriage but remain stationary e.g. so-called "page-width" printers. Moreover, the cleaning procedure could be utilized outside the field of ink jet printing, being applicable to other situations involving the periodic cleaning of fluid discharge orifice/nozzles.

We claim:

1. An ink jet printer comprising:

a printhead having a printhead face directed towards a recording medium, at least one ink channel within the printhead, an ink ejecting orifice at one end of the channel in the printhead face, and means operable to cause ink droplets to be expelled from the ink ejecting orifice and propelled towards the recording medium; and a maintenance station including a cap member movable towards and away from the printhead without wiping or scraping the printhead face and having a first position in which the cap member engages the printhead face and caps the printhead orifice and a second position in which the cap member is directed towards but spaced apart from the printhead face, and means for selectively applying a suction to the cap member in the first position to prime the printhead through the ink ejecting orifice or to clear the ink channel and in the second position to draw air over the printhead face to clean the printhead face, and said suction applying means being operable to apply suction to the cap member during movement of the cap member from the first to the second position.

2. A printer as claimed in claim 1, including means for moving the cap member and the printhead relative to one another in a direction parallel to the printhead face while the cap member is spaced apart from the printhead face in the second position and said suction applying means is in operation, thereby applying a suction to the cap member while the cap member and printhead are moving relative to each other.

3. A printer as claimed in claim 2, in which the printhead is mounted on a scanning carriage for reciprocal movement across the recording medium and in which the maintenance station is located to one side of the recording medium; the means for moving the cap member relative to printhead being effected by moving the scanning carriage from a position in which the printhead is engageable by the cap member to a position in which the printhead can propel ink droplets towards the recording medium.

4. A method of cleaning a printhead face includes:

providing an ink jet printer comprising a printhead having a printhead face directed towards a recording medium, at least one ink channel within the printhead, an ink ejecting orifice at one end of the channel in the printhead face, and means operable to cause ink droplets to be expelled from the ink ejecting orifice and propelled towards the recording medium;

providing a maintenance station to which the printhead is movable and which includes a cap member movable towards and away from the printhead;

moving the cap member into a position in which the cap member is in engagement with the printhead face without wiping or scraping the printhead face to cap the ink ejecting orifice; and applying suction to the cap member when the cap member is in engagement with the printhead face to prime the printhead through the ink ejecting orifice or to clear the ink channel; and moving the cap member from engagement with the printhead face into a position in which the cap member is confrontingly spaced apart from the printhead face, while continuing to apply suction thereto.

5. The method of claim 4, including the step of moving the cap member and the printhead relative to one another in a direction parallel to the printhead face while the cap member is spaced apart from the printhead face and continuing to apply suction to the cap member.

6. A method of cleaning a printhead surface having at least one fluid ejecting nozzle therein, the method including:

positioning a cap member with an open suction chamber against the printhead surface without wiping or scraping the printhead surface, so that the fluid ejecting nozzle in the printhead surface is sealingly surrounded by the suction chamber;

applying suction to the cap member to draw fluid through the nozzle; and moving the cap member a predetermined distance away from the printhead surface while continuing to apply suction thereto, whereby the suction stops drawing fluid through the nozzle and draws air over the printhead surface, thereby cleaning the printhead surface.

7. A method as claimed in claim 6, further including: moving the cap member and the printhead surface relative to one another in a direction parallel to the printhead surface without wiping or scraping the printhead surface and continuing to apply suction to the cap member while the cap member is spaced a predetermined distance from the printhead surface to carry any fluid or contaminants away from the nozzle without risk of sweeping the contaminants back into the nozzle and without risk of damaging the printhead surface.

8. A printhead cleaning assembly for an ink jet printer having a printhead with at least one ink channel therein, an ink ejecting orifice at one end of the channel for directing droplets of ink expelled from the orifice towards a recording medium, and a printhead face which contains the ink ejecting orifice, the printhead cleaning assembly comprising:

a cap member having an open suction chamber therein operable to draw air over and thereby clean the printhead face when a suction is applied thereto, the cap member being locatable relative to the printhead, without wiping or scraping the printhead face, to place the cap member in a cleaning position, whereat said open suction chamber confronts the printhead face and is spaced a predetermined distance therefrom, the cap member being movable from the cleaning position to a capping position in which the open suction chamber engages the printhead face and sealingly surrounds the ink ejecting orifice; and a source of suction being selectively operable to apply suction to said open suction chamber when the cap member is in the cleaning position, when the cap member is in the capping position, and when the cap member is moved away from the capping position and towards the cleaning position.

9. The cleaning assembly as claimed in claim 8, wherein the cleaning assembly and printhead are movable relative to each other in a direction parallel to the printhead face, while the cap member is in the cleaning position; and wherein the source of suction is operable to apply a suction to the cap member, when the cleaning assembly and printhead are moved relative to each other.

10. The cleaning assembly as claimed in claim 9, in which there are a linear array of ink ejecting orifices with a predetermined length in the printhead face and said relative movement is in a direction perpendicular to the length of the array.

* * * * *